US005513888A

United States Patent [19]

Kirkland

[11] Patent Number: 5,513,888

[45] Date of Patent: May 7, 1996

[54] BOTTLE HOLDER

[76] Inventor: Danny Kirkland, Rte. 3, Box 200, Alvarado, Tex. 76009

[21] Appl. No.: 418,836

[22] Filed: Apr. 7, 1995

[51] Int. Cl.[6] ..... B65D 71/00

[52] U.S. Cl. ..... 294/87.26; 294/159

[58] Field of Search ..... 294/87.1, 87.2, 294/87.26, 87.28, 159, 162, 163, 165; 206/145, 161, 167–169, 199, 427

[56] References Cited

U.S. PATENT DOCUMENTS

| | | | |
|---|---|---|---|
| 2,287,731 | 6/1942 | Franks et al. | 294/87.26 |
| 2,337,243 | 12/1943 | Hutaff | 294/87.26 |
| 2,386,101 | 10/1945 | Firks et al. | 294/87.26 |
| 2,395,755 | 2/1946 | Parks | 294/87.26 |
| 2,407,529 | 9/1946 | Bertram | 294/87.26 |
| 2,437,800 | 3/1948 | Andersen | 294/87.26 |
| 2,442,636 | 6/1948 | Bertram | 294/87.26 |
| 2,454,178 | 11/1948 | Howell | 294/87.26 |
| 2,457,027 | 12/1948 | Bertram | 294/87.26 |
| 4,037,766 | 7/1977 | Iacono | 294/87.26 X |

*Primary Examiner*—Johnny D. Cherry
*Attorney, Agent, or Firm*—Arthur F. Zobal

[57] ABSTRACT

Two slidable plates are provided which can be moved to first positions for providing expanded passages for receiving the necks of bottles and to second positions to provide contracted passages for engaging and holding the necks of the bottles. A spring biased mechanism is provided for releasably securing the plates in the first and second positions.

1 Claim, 3 Drawing Sheets

BOTTLE HOLDER

BACKGROUND OF THE INVENTION

1. Field of the Invention

The invention relates to slidable plates for releasably holding bottles of the type having a narrow neck and an enlarged head.

2. Description of the Prior Art

The following U.S. Pat. Nos. disclose different types of bottle holders: 2,287,731; 2,337,243; 2,386,101; 2,395,755; 2,407,529; 2,442,636; 2,457,027; and 4,037,766.

SUMMARY OF THE INVENTION

It is an object of the invention to provide a new and useful bottle holder of the type having slidable plates with a spring biased mechanism for releasably securing the plates in first positions to provide expanded passages for receiving the necks of bottles and in second positions to provide contracted passages for engaging and holding the necks of the bottles.

DESCRIPTION OF THE PREFERRED EMBODIMENT

Figure 5:
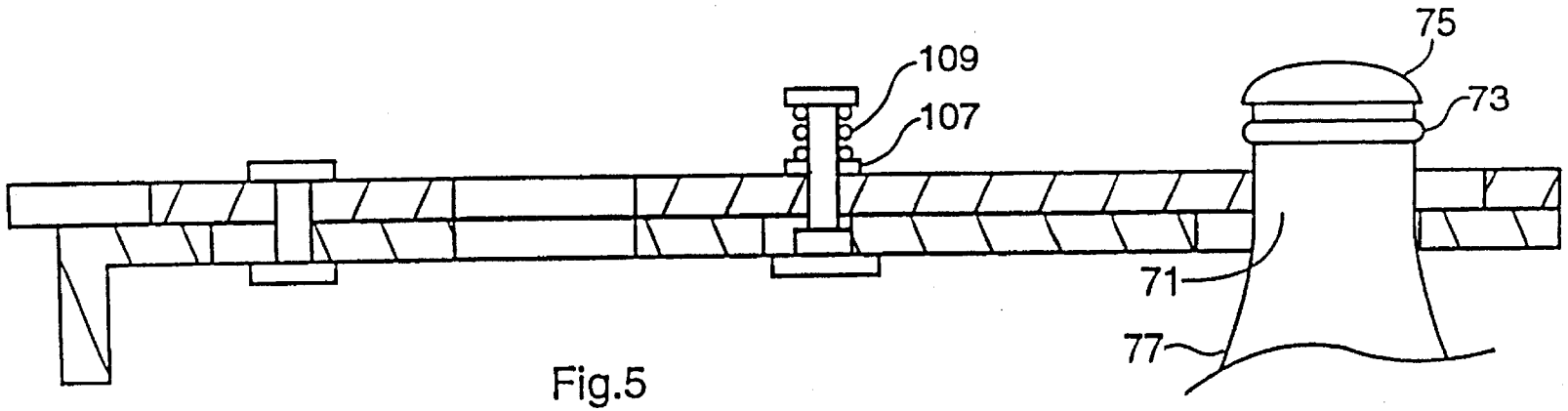
FIG. 5 is a cross-sectional view of FIG. 3 taken along lines 5—5 thereof.

Referring now to the drawings, the bottle holder and carrier of the invention is identified by reference numeral 21. It comprises a flat top plate 23 and a fiat bottom plate 25. The top plate 23 has six round bottle neck receiving holes 31A–31F, two finger gripping holes 33A and 33B, three apertures 35, 37, and 39 extending therethrough, and a tab 41 extending in the plane of the plate. The bottom plate 25 has six round bottle neck receiving holes 51A–51F, two finger gripping holes 53A and 53B, and three apertures 55, 57, and 59 extending therethrough, and a tab 61 extending transverse to the plane of the plate. As shown in FIG. 5, plate 25 is longer than plate 23; however, both plates have the same width and the same thickness.

Figure 1:
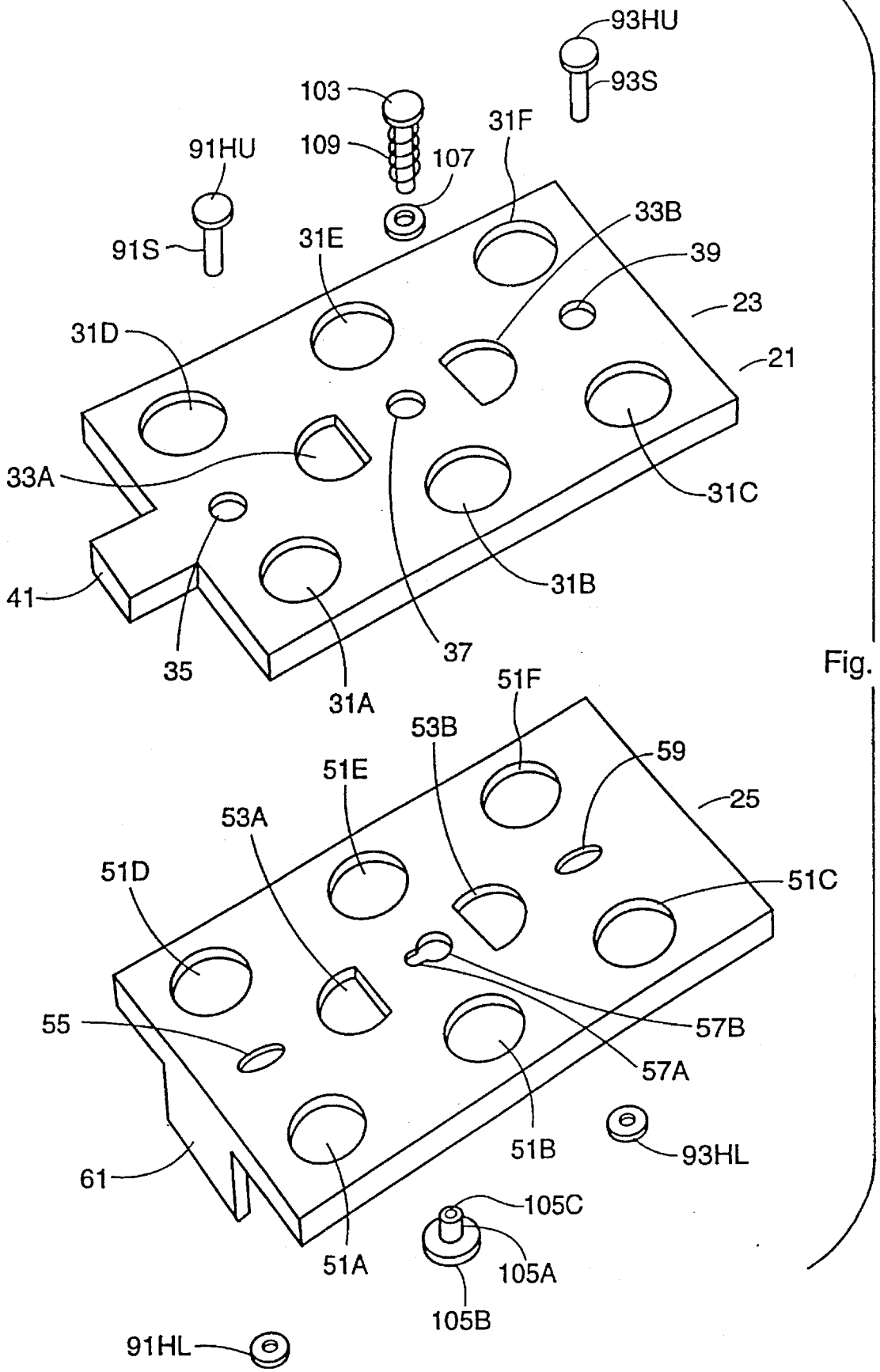
FIG. 1 is an exploded view of the apparatus of the invention.
Figure 2:
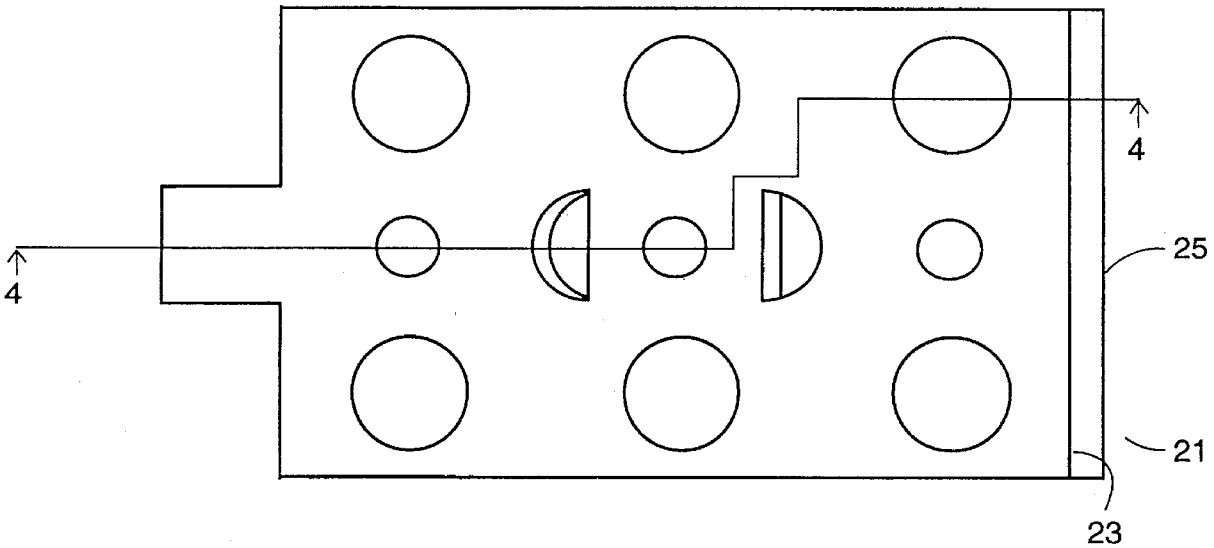
FIG. 2 is a top plan view of the apparatus of FIG. 1 with the plates located in a position such that the bottle receiving passages are in expanded positions.
Figure 3:
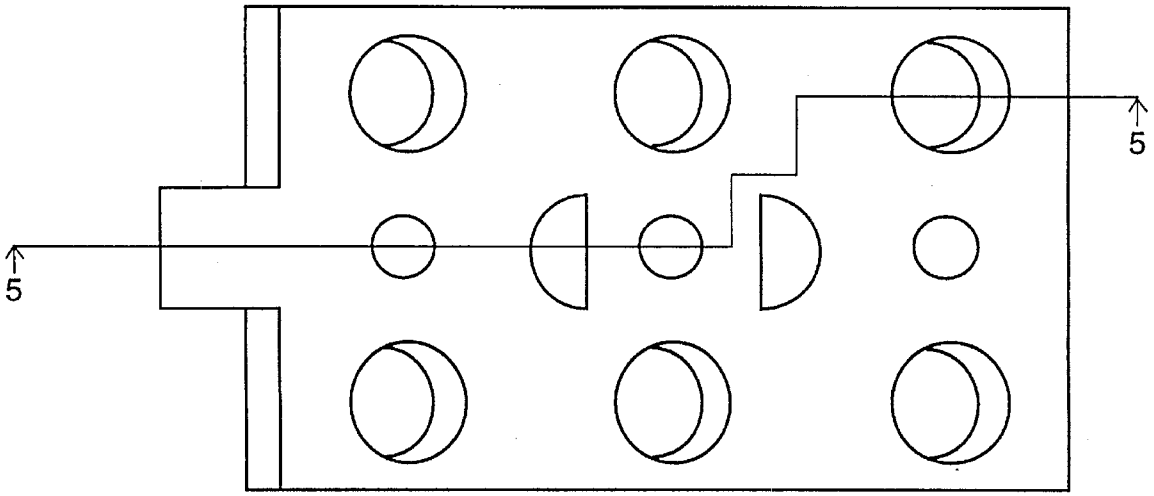
FIG. 3 is a top plan view of the apparatus of FIG. 1 with the plates located in a position such that the bottle receiving passages are in contracted positions.
Figure 4:
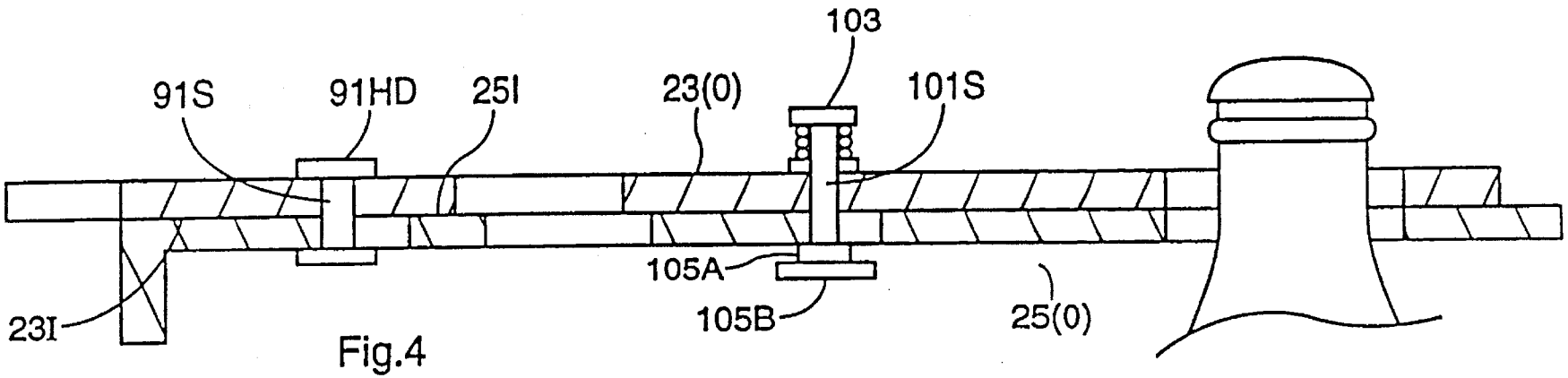
FIG. 4 is a cross-sectional view of FIG. 2 taken along lines 4—4 thereof.

The plates 23 and 25 have inward facing sides 23(I) and 25(I) and outward facing sides 23(O) and 25(O) with the inward facing sides 23(I) and 25(I) adapted to face and engage each other as shown in FIGS. 4 and 5. The plates 23 and 25 can slide relative to each other in opposite directions to first and second positions as shown in FIGS. 2 and 3. Securing members 91 and 93 located in apertures 35 and 55 and 39 and 59 are used to slidably hold the plates together for movement to first and second positions. In the first positions, apertures 31A–31F are exactly aligned with apertures 51A–51F to form expanded passages to receive the neck 71, a larger portion 73 and a cap 75 of a bottle 77 as shown in FIG. 4. In the second positions, apertures 31A–31F are partially aligned with apertures 51A–51F to form contracted passages to allow the walls of the plates 23 and 25 forming openings 31A–31F and 51A–51F to engage opposite sides of the necks of the bottles but preventing the enlarged head portions 73 from passing through to allow the apparatus to hold the bottles for carrying purposes.

In the first positions of the plates, the finger gripping openings 33A and 33B are partially aligned with openings 53A and 53B respectively as shown in FIGS. 2 and 4 and in the second positions of the plates, the finger gripping openings 33A and 33B are completely aligned with finger gripping openings 53A and 53B as shown in FIGS. 3 and 5.

Members 91 and 93 are used to hold the plates 23 and 25 together for slidable movement to the first and second positions. The member 91 has a cylindrical shank 91S which extends through apertures 35 and 55. Enlarged heads 91HU and 91HL are connected to the opposite ends of shank 91S. The member 93 has a cylindrical shank 93S which extends through apertures 39 and 59. Enlarged heads 93HU and 93HL are connected to opposite ends of shank 93S. The apertures 35 and 39 are cylindrical such that the shanks 91S and 93S cannot move laterally in these apertures. The apertures 55 and 59 are elongated allowing the shanks to move laterally in these apertures thus allowing the plates 23 and 25 to move lateral in the first and second opposite directions as described above. The shank 91S can be screwed to head 91HL and the shank 93S can be screwed to head 93HL.

A locking number 101 is employed for removably locking the plates 23 and 25 together when the passages of openings 31A–31F and 51A–51F are in their contracted positions. The locking member 101 comprises a cylindrical shank 101S with an enlarged head 103 at one end and an enlarged head 105A, 105B at the other end. The aperture 37 is cylindrical preventing the shank 101S from moving laterally in the aperture 37 but allowing the shank 101S to move upward and downward in the aperture 37. A washer 107 is located around the shank 10IS on the outside of the plate 23. A coiled spring 109 is located around the shank 101S and has one end seated against the head 103 and an opposite end seated against the washer 107 which urges the shank 101S and heads 103, 105A, and 105B in an upper position. The aperture 57 has a narrow portion 57A and an enlarged portion 57B. The enlarged head portion 105A can fit into the enlarged portion 57B of the aperture 57 but the enlarged head portion 105A cannot fit into narrow portion 57A of the aperture 57. The enlarged head portion 105B cannot fit in either portions 57A or 57B of the aperture 57.

When the plates 23 and 25 are in the positions as shown in FIG. 4 wherein the passages of the openings 31A–31F and 51A–51F are in their expanded positions, the shank 101S is in aperture 37 and in the narrow portion 57A of aperture 57 with the enlarged head portion 105A engaging the outside of the plate 25, causing the head 103 to compress the spring 109. The bottle necks can be fitted into the expanded passages from the bottom side of the plate 25 and by gripping tabs 61 and 41, the plate 23 can be slid to the right as seen in FIGS. 4 and 5 relative to plate 25 until the enlarged head portion 105A enters the enlarged hole portion 57B contracting the bottle passages and locking the plates together as seen in FIG. 5. The spring 109 urges the member 101 upward maintaining the enlarged head portion 105A in enlarged hole portion 57B. The plates 23 and 25 and bottles 77 are carried by gripping the gripping apertures 33A, 53A, and 33B, 53B. When it is desired to release the bottles, the head 103 is pushed downward, moving the enlarged head portion 105A out of the enlarged hole portion 57B and the plate 23 is slid to the left as shown in FIGS. 4 and 5 relative to the plate 25 to expand the bottle passages as shown in FIG. 4 to allow the bottles to be removed from the plates.

In one embodiment, the plate 23 has a length of about 8 inches, a width of about 5 inches, a thickness of about ⅛ of an inch. The plate 25 has a length of about 8½ inches, a width of about 5 inches, and a thickness of ⅛ of an inch. The plates 23 and 25 can be formed of a suitable plastic. It is to be understood that the dimensions of the plates and apertures and the number of bottle receiving apertures may be different from those listed above depending on the number and size of the bottles to be held. The shank 101S may be screwed into threaded aperture 105C of head member 105A, 105B, to hold the member 101 in place.

The holes 31A–31F and 51A–51F may have diameters of about 1 6/16 inches depending on the type of bottles the apparatus is intended to hold.

I claim:

1. A bottle holder and carrier, comprising:

first and second planar type plates having first and second sides facing each other and outer sides facing in opposite directions;

securing means for slidably securing said plates together to allow at least one of said plates to slide laterally relative to the other of said plates in first and second opposite directions;

said plates having aligned openings providing passages through said plates which may be expanded and contracted by sliding said one plate relative to the other of said plates in said first and second directions to first and second positions respectively, said passages when expanded enabling the heads and necks of bottles to be passed therethrough and when contracted, enabling said plates to engage the necks and prevent withdrawal of the bottles;

first and second apertures extending through said plates in alignment with each other when said passages are expanded and contracted;

one of said apertures having a narrow portion and an enlarged portion and having a length greater than that of the other of said apertures such that said one aperture is in alignment with the other of said apertures when said passages are expanded and contracted;

a locking member having a shank extending through said apertures;

said shank having opposite ends with enlarged control and locking heads coupled thereto and located on opposite sides of said plates respectively;

said locking member being movable in said apertures transverse to the planes of said plates to upper and lower positions with said locking head being located on the outer side of said plate having said aperture with said narrow and enlarged portions;

said locking head being locatable in said enlarged portion but being unable to be located in said narrow portion;

a spring located around said shank between said control head and the outer side of said other plate for normally urging said locking member to said upper position such that when said one plate is in said first position relative to said other plate, said passages are in their expanded positions and said locking head is located next to but outside of said narrow portion of said one aperture such that said one plate may be slid to said second position relative to said other plate with said spring urging said locking head into said enlarged portion of said one aperture to lock said plates together with said passages in said retracted positions and when desired to release the bottles, said control head may be pushed against said spring to move said locking head out of said enlarged portion of said one aperture to allow said one plate to be moved relative to said other plate to move said passages to their expanded positions.

* * * * *